United States Patent [19]

Carlos et al.

[11] 4,456,523

[45] Jun. 26, 1984

[54] PROCESSES FOR PRODUCING HIGH GRADE ASPHALTIC MATERIALS FROM LOW GRADE BITUMINOUS MATERIALS AND PRODUCTS RESULTING THEREFROM

[75] Inventors: Donald D. Carlos, Louisville; Charles R. Gannon, Ashland; Robert H. Wombles, Worthington, all of Ky.

[73] Assignee: Ashland Oil, Inc., Ashland, Ky.

[21] Appl. No.: 320,916

[22] Filed: Nov. 12, 1981

Related U.S. Application Data

[63] Continuation-in-part of Ser. No. 210,010, Nov. 24, 1980, abandoned.

[51] Int. Cl.[3] ..... C10C 3/04

[52] U.S. Cl. ..... 208/5; 208/6; 208/22

[58] Field of Search ..... 208/5, 6, 22

[56] References Cited

U.S. PATENT DOCUMENTS

| | | | |
|---|---|---|---|
| 1,782,186 | 11/1930 | Abson | 208/5 |
| 2,179,208 | 11/1939 | Burk et al. | 208/5 |
| 2,287,511 | 6/1942 | Burk et al. | 208/5 |
| 2,370,007 | 2/1945 | Carr | 208/5 |
| 2,421,421 | 6/1947 | Hoiberg | 208/5 |
| 2,506,283 | 5/1950 | Smith et al. | 208/22 X |
| 3,126,329 | 3/1964 | Fort | 208/4 |
| 3,440,073 | 4/1969 | Fowler et al. | 208/6 |
| 3,607,334 | 9/1971 | Fauber | 208/22 X |
| 4,052,290 | 10/1977 | Cushman et al. | 208/6 |

*Primary Examiner*—Delbert E. Gantz
*Assistant Examiner*—O. Chaudhuri
*Attorney, Agent, or Firm*—Richard C. Willson, Jr.

[57] ABSTRACT

Disclosed is a process for producing high grade asphaltic materials from low grade bituminous materials and the improved products resulting therefrom. More particularly, there is disclosed a process utilizing a particular type of oxidation catalyst in preparing novel high quality paving grade asphalt cements and novel roofing grade asphalts from poor and marginal quality bituminous materials. Also, the process can be used to prepare novel superior quality asphaltic materials from good quality bituminous flux feedstocks. This process consists of catalytically oxidizing asphalt fluxes, for example, in a single or multi-stage oxidation, using the particular type of catalyst disclosed hereinafter in each stage to chemically modify the flux so that the resultant asphaltic material meets physical requirements necessary for a finished product possessing good temperature susceptibility characteristics.

55 Claims, 3 Drawing Figures

AC-20 ASPHALT CEMENT OXIDIZED WITH AND WITHOUT CATALYST

OXIDATION OF ROOFING COATING WITH SODIUM CARBONATE, FERRIC CHLORIDE, AND NO CATALYST

PROCESSES FOR PRODUCING HIGH GRADE ASPHALTIC MATERIALS FROM LOW GRADE BITUMINOUS MATERIALS AND PRODUCTS RESULTING THEREFROM

This application is a continuation-in-part application of Ser. No. 210,010, filed Nov. 24, 1980, now abandoned.

BACKGROUND OF THE INVENTION

1. Field of Invention

This invention relates to catalytic processes for improving asphaltic materials and the products resulting therefrom. This invention is concerned in one specific embodiment with chemically producing paving grade asphalt cements and in another embodiment with chemically producing roofing grade asphalts each being less susceptible to changes in temperature and methods for manufacturing the same through catalytic oxidation of paving grade or roofing grade asphalt flux feedstocks.

2. Prior Art

Historically paving grade asphalts were produced by the refiner by various methods or combinations of methods such as atmospheric distillation of crude oil with subsequent vacuum distillation to obtain the desired asphaltic product. Another method is air blowing, with or without an oxidation catalyst, a soft vacuum tower residual at 350°–550° F. either by a batch method or continuous in line oxidation to the desired product specification. Another method is to solvent precipitate a soft vacuum tower residual to product specifications; and still another method is to solvent precipitate a soft vacuum tower residual to a low penetration hard asphalt followed by back blending with a softer vacuum bottoms to achieve the proper specification characteristics.

All of the aforementioned methods can be used singularly or in combination to produce high quality asphaltic products. The choice of methods, in reality, is dependent upon the crude type. This invention is concerned with the above processes where air blowing in the presence of an oxidation catalyst is employed. We have discovered that by using the catalyst of the present invention, the "blowing curve" of the asphalt flux can be altered to produce a product having a higher penetration at a given softening point and in remarkably shorter time. As can be appreciated, both of these attributes are of considerable economic value.

In the past, bituminous materials, particularly asphalt materials, have been treated by passing an oxidizing gas through the bituminous materials in a molten condition. The effect of the conventional type of air-blowing is to partially oxidize the asphalt in a manner resulting in decreasing penetration and increasing viscosity and softening point. To promote the oxidation process, oxidizing catalysts have been utilized in the past. U.S. Pat. No. 1,782,186 states that the chloride, carbonate and sulfate salts of zinc, iron, copper or antimony can be used as catalyst in air blowing petroleum residuals to asphaltic materials. U.S. Pat. No. 1,782,186 exemplifies only the use of the chloride salt. Also, U.S. Pat. Nos. 2,179,208 and 2,287,511 describe processes for making asphalt. In all of the examples of U.S. Pat. Nos. 2,179,208 and 2,287,511, residuum is first air blown and then "polymerized" using halides of certain metals as catalysts. These two patents list other catalyst possibilities, including sodium carbonate. U.S. Pat. No. 3,440,073 discloses a method for deodorizing asphalt for use as sealants in refrigerators and freezers wherein air and steam are blown through molten asphalt flux to which has been added a small or minor quantity of a water solution of one or more water-soluble inorganic alkaline materials, such as sodium hydroxide, sodium carbonate, potassium hydroxide and potassium carbonate. The primary purpose of said treatment is to deodorize asphalt for special applications. Other patents of relevance to this invention are U.S. Pat. Nos. 2,370,007; 2,421,421; and 3,126,329.

Penetration by definition is the consistency of a bituminous material expressed as the distance in tenths of a millimeter that a standard needle vertically penetrates a sample of material under known conditions of loading, time, and temperature. In essence, the penetration of a bituminous material is synonymous with viscosity at the temperature specified.

Viscosity may simply be defined as the measure of the resistance to flow of a liquid in the presence of a force. It has been shown desirable in asphalts such as paving asphalts to have a high penetration at a given viscosity. For example, an asphalt pavement constructed with asphalt cement having a penetration at 77° F./100 g/5 sec. of 40, viscosity at 140° F. at 2000 poises, and a viscosity at 275° F. of 300 centistokes would not perform as well as the same asphalt having the same viscosities but a penetration at 77° F./100 g/5 sec. of 60. The 40 penetration asphalt at lower temperatures (below 77° F.) would become brittle and break up under repeated traffic load. In other words, the 40 penetration asphalt at 77° F. is more susceptible to changes in temperature.

One object of this invention is to catalytically produce a paving grade asphalt which is less susceptible to changes in temperature. Another object of this invention is to reduce the oxidation time. Another object of this invention is to provide an improved process for producing said asphalt. Still another object of this invention is to provide an improved and novel paving grade asphalt product.

Roofing asphalts are markedly different from paving asphalts. The air blowing process is frequently employed to manufacture certain paving grade asphalts; however, all roofing asphalts are manufactured by the air blowing process. One very important similarity exists between paving grade asphalts and roofing asphalts, i.e., a higher penetration at a given softening point is desirable. In other words, it is desirable to produce a roofing asphalt which is less susceptible to temperature change. Roofing manufacturers have historically used softening point which, in essence, is another method to designate viscosity.

Some roofing fluxes (roofing asphalt precursors) can be air blown to specifications without the use of a catalyst. Some require a catalyst. The use or non-use of a catalyst usually depends on the type of crude from which the roofing flux is derived. Refiners and asphalt roofing manufacturers have historically utilized Lewis acid catalysts such as halides of iron, aluminum, copper, tin, zinc, antimony, as well as phosphorus pentoxide in the production of roofing grade asphalts. Ferric chloride and phosphorous pentoxide are presently the most commonly used catalysts. These catalysts work quite well except they are very corrosive, and the amount of maintenance required on storage tanks, fume burners, pumps, etc. amounts to millions of dollars annually. In addition, the Lewis acid catalyzed asphalts deteriorate cellulosic-based products, such as roofing felts, spreading mops, etc., which are used during the manufacturing and application processes.

One of the objects of this invention is to catalytically produce a novel roofing asphalt which is less susceptible to changes in temperature. Another object of this invention is to reduce processing costs, and increase operating capacity by reducing the time for air blowing a roofing flux to roofing asphalt specification requirements. The reduction in total oxidation time is associated with the accelerated catalytic initiation of the oxidation reaction followed by a pronounced exotherm. Another object of this invention is to greatly reduce maintenance costs by utilizing a new non-corrosive, inexpensive, readily available catalyst. A further object of this invention is to provide a roofing asphalt which does not deteriorate cellulosics used in the roofing manufacturing and application processes. It is also an object of this invention to achieve an end product improvement over roofing asphalts produced by conventional catalysts known to the art such as ferric chloride, phosphorous pentoxide, etc., Another object of this invention is to produce, by catalysis, a novel, improved roofing material from a bituminous material which, when subjected to the normal non-catalytic air blowing process produces inferior roofing asphalts. Another object of this invention is to produce, by catalysis, a superior asphaltic roofing material exceeding specifications from a bituminous material which when subjected to the normal non-catalytic air blowing process produces only acceptable quality roofing asphalt. Another object of this invention is to provide improved catalytic processes for producing said asphalt.

Further objects of this invention will be apparent to the skilled artisan from the Summary and Detailed Description of the Invention, hereinbelow.

SUMMARY OF THE INVENTION

Briefly stated, this invention comprises processes for oxidizing asphaltic flux bituminous materials having boiling points above 850° F. which consist of blowing an oxidizing gas through a molten mixture of said bituminous materials in the presence of a catalytic amount of an oxidizing catalyst comprising an organic or an inorganic carbonate salt. The oxidizing catalyst can be either in the dry state, dissolved in water, slurried with water or slurried with bituminous feedstock material. The oxidation is conducted under a suitable condition of gas flow and temperature to oxidize the bituminous material to desired asphalt physical properties.

In a preferred embodiment, the oxidizing catalyst in the form of dry particles is injected directly into the asphalt flux.

In another preferred embodiment, the catalyst is a sesquicarbonate.

In a most preferred embodiment of this invention, the catalyst is sodium carbonate and either a paving grade asphalt or a roofing grade asphalt is produced, largely depending upon feedstock selection and oxidation time.

In another aspect, this invention comprises the oxidized asphaltic materials resulting from the aforedescribed processes.

In particular, this invention comprises: a non-corrosive catalyst which produces from poor quality bituminous materials, high quality finished asphaltic materials, without the need of corrosive Lewis acid catalysts, useful as roofing or paving products that are less susceptible to changes in temperature than comparable asphalts produced without catalysts, and the processes for producing same. The catalysts and related processes can also be used to further improve the quality of asphaltic materials derived from good quality asphalt fluxes. A possible added benefit of the present invention is that the process embodiments thereof do not produce chlorinated aromatics.

In certain preferred product embodiments of this invention, the asphalt product is characterized by an unusually small concentration of saturates as determined by clay gel analysis. The asphalt product of this invention is characterized by containing 25% to 85% less saturates than the concentration thereof in the starting flux.

More specifically, in preferred product embodiments, the present invention provides a catalytically oxidized paving grade or roofing grade asphalt. The paving grade asphalt comprises (by clay gel analysis, n-pentane solvent), about 15 to 25% pentane insoluble asphaltenes, about 3 to 15% saturates, about 30 to 50% polar compounds and about 25 to 35% aromatics, the total content being 100%, the sum of the asphaltenes and polar compounds being preferably about at least 55%. The roofing grade asphalt comprises about 35 to 45% pentane insoluble asphaltenes, about 5 to 30% saturates, about 30 to 40% polar compounds, with the remainder being about 10 to 30% aromatics, the sum of the asphaltenes and polar compounds being preferably about at least 70%. For both the paving and roofing grade products of the invention, the % saturates is at least 25% less than the saturate content of the starting flux, preferably at least 75% less, most preferably 80 to 85% less than the saturate content of the starting flux. Indeed, most preferably, the asphalt products of this invention will contain less than 8% saturates.

DETAILED DESCRIPTION OF THE INVENTION

Figure 1:
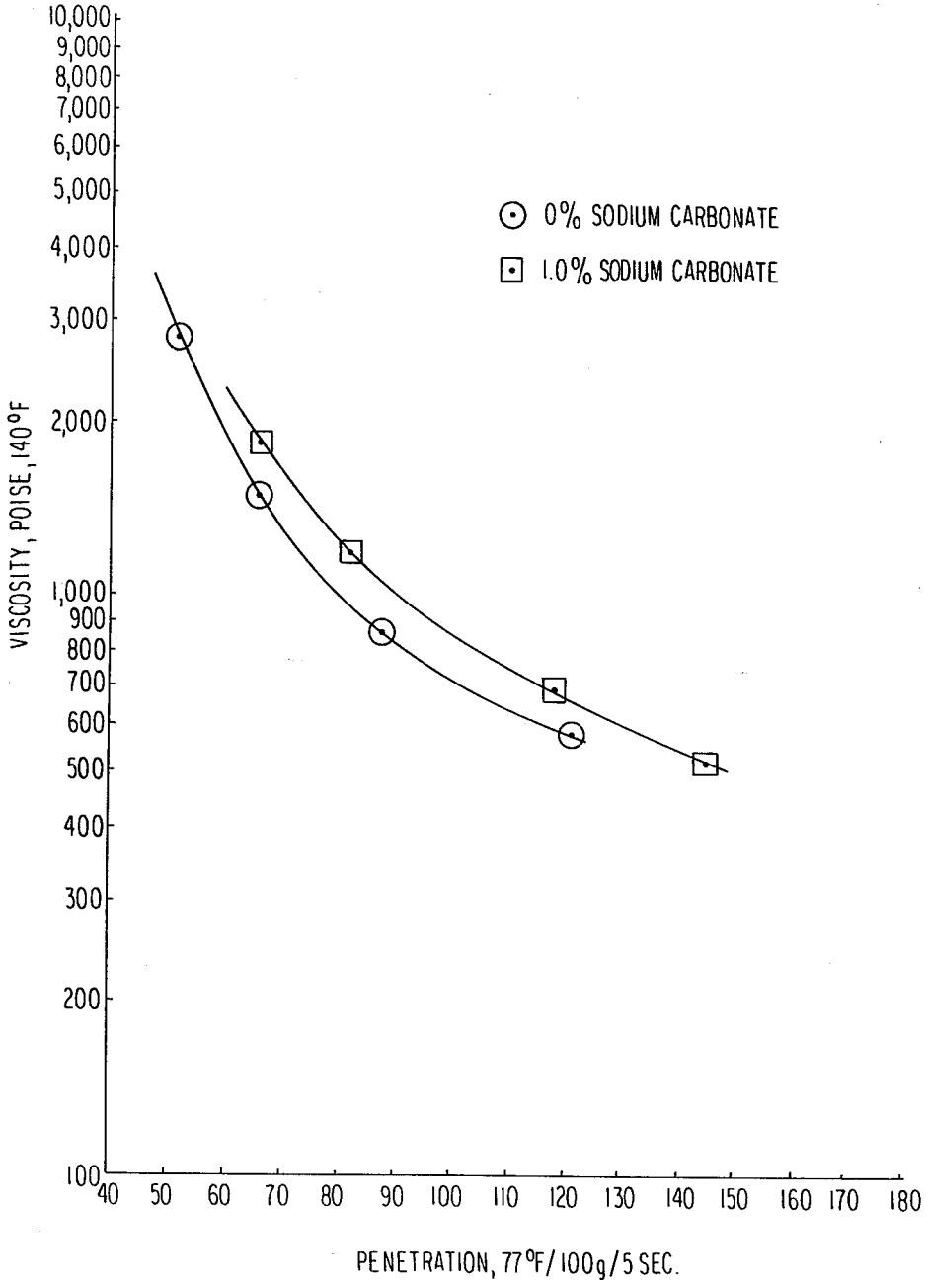
FIG. 1 of the Drawing is a graph in which viscosity is plotted versus penetration for identical asphalt fluxes oxidized with and without the presence of 1.0% sodium carbonate.

Generally speaking, air blowing or oxidation of bituminous flux materials by the batch process is carried out as follows: Horizontal, or more commonly, vertical vessels with some means of heating such as direct fired burners, high pressure steam heat exchangers, etc. capable of maintaining temperatures up to 550° F. are employed. Various methods of controlling and dispersing air through the molten flux material are used. Most "batch oxidizers" are equipped with a cooling device such as a heat exchanger within or outside the vessel or a system for spraying water or injecting steam into the top of the vessel to quench the normally exothermic reaction experienced in the air blowing process. Batch oxidation is usually employed in manufacturing roofing grade asphalts.

Another type of oxidation process is a continuous process whereby a fresh bituminous feedstock material is continuously charged or fed into an oxidizer wherein catalyst and air are continuously and concurrently dispersed and contacted with the molten material on a "once-through" basis. The product, i.e., asphaltic material, is continuously discharged from the oxidizer. The process can be used for any type of bituminous feedstock material and is particularly useful in producing paving grade asphalt cements.

Although a number of carbonate salts are deemed suitable as catalysts for the present process, the preferred catalysts are the carbonate salts of sodium, and in particular, sodium carbonate or sodium sesquicarbonate, and mixtures thereof. Accordingly, other salts such as the carbonate salts of calcium, magnesium, barium and strontium may also be used as catalysts. The amount of catalyst utilized in the process of this invention to oxidize or air blow the molten flux, depending on the type of flux, can range between 0.01 and 5.0%, based on the weight of the flux material.

At times, it may be useful to utilize a catalytic salt which breaks down under heat to yield the carbonate as a decomposition product. Indeed, it is believed that the sesquicarbonate functions in this manner. The combination of carbonate plus sesquicarbonate may provide a means of continually supplying carbonate over a long period of time. Another carbonate precursor which may function satisfactorily under certain conditions is the corresponding bicarbonate salt. Similarly, an oxidation product of carbonate or bicarbonate, such as a peroxycarbonate, for example, sodium peroxycarbonate, could be employed to provide an active oxidation catalyst product. The term "carbonate salt catalyst" as used herein is meant to include not only compounds which from a nomenclature standpoint are carbonate salts, but also those materials as above discussed which yield carbonate as a decomposition product or which are carbonate or bicarbonate oxidation products.

According to the present invention, asphaltic materials for paving and roofing are produced from low grade bituminous materials, i.e., asphalt fluxes, which are derived from several sources.

The flux material, i.e., the liquid bituminous material is selected from the group consisting of slurry oil, coal tar pitch, coal tar, petroleum pitch, cycle oils, asphalt, cylinder stock, liquid derived from shale, coal liquifaction materials and aromatic furfural extracts from the solvent refining of lube oil and mixtures thereof.

In the oxidation processes, a bituminous feedstock material as aforementioned is fed into a vessel and is heated to a temperature ranging between about 300° and about 550° F. An oxidizing gas, such as air, is introduced into the flux material to oxidize the flux in the presence of the catalyst. The process is carried out for a sufficient length of time at about 450° to 550° F. to provide the type of asphaltic material desired, that is, an asphaltic material to be used for asphalt paving cements, roofing asphalts, including those used for built-up roofing, shingle saturates and shingle coatings. The present invention can lead to a reduction in oxidation time of at least about 10%, often over 20%.

The time of addition of catalyst to the flux in relationship to the beginning of introduction of the oxidizing gas is unimportant in the present invention as long as the oxidizing gas is used to oxidize the flux in the presence of the catalyst. For example, all of the catalyst could be loaded into the oxidizer before the introduction of the flux. Then, the flow of oxidizing gas could be started concurrently with the introduction of the flux or thereafter. This method is particularly suitable for batch operations. It is even possible to proceed in the opposite direction, that is start the flow of oxidizing gas before introduction of catalyst. The important parameter herein is that oxidation is carried out in the presence of the catalyst, whether the oxidation is accomplished in a single stage or in multiple stages. Where multi-stage oxidation is employed, it is possible to carry out one or more stages of oxidation without the presence of the catalyst, although at present it is thought that such a procedure would not fully enjoy the benefits flowing from this invention. Of course, a multi-stage process could be continuous or discontinuous, i.e., the use of a continuous oxidizer followed by one or two stages of batch oxidation.

The bituminous flux material has a viscosity ranging from about 30 to about 400 Saybolt Furol Seconds (SFS) at 210° F., and a flash point preferably of at least 580° F. Lower flash point materials can be used if the oxidation temperature is maintained at about 50° F. below the flash point for safety purposes.

In the process, the period of time required to respectively batch oxidize a roofing asphalt and a paving asphalt cement is quite different. In the case of an asphalt roofing coating, the oxidizing gas is passed through the flux containing the catalyst for a period of time, for example, ranging from about 2 to about 35 hours, whereas, in the case of producing the asphalt paving cement, the oxidizing gas is passed through the bituminous material containing the catalyst for a period of time, for example, ranging from about ½ hour to about 6 hours. These are merely suggested oxidation times.

The oxidizing gas that is passed through the flux or bituminous material may be one of several gases, including oxygen, air, compressed air, or liquid air. The oxidizing gas is passed through the flux material at a rate between about 20 and about 35 cubic feet per hour per ton of bituminous material.

The catalyst, as described above, that is used with the oxidizing gas is primarily a carbonate salt. The catalysts of the invention that may be used in this process include sodium carbonate, sodium bicarbonate, sodium sesquicarbonate, tetraalkylammonium carbonates, sodium cerium carbonate, trialkylammonium carbonates, dialkylammonium carbonates, or a carbonate salt of calcium, magnesium, lithium, cerium, potassium, barium, ammonium, strontium, transition metals, rare earth metals, bismuth, lead, tetraalkylphosphonium or tetraarylphosphonium. The catalyst is injected or introduced into the flux material in a water solution, water slurry, or slurried with said flux or in a preferred embodiment injected or introduced in a dry crystalline or powder form. The catalyst of the invention can be used in admixture with a conventional asphalt flux oxidation catalyst.

The amount of catalyst introduced into the flux material ranges from about 0.01 to about 5.0 wt. %, of the bituminous material, depending on type, preferably 0.1 to 1.0 wt. % for a paving asphalt cement, or 0.01 to 2.0 wt. % for a roofing shingle saturant and roofing shingle coating or built-up roofing asphalt material.

A starting flux for a paving grade asphalt will usually contain about 10 to 20% asphaltenes, about 15 to 25% saturates and about 20 to 35% polar compounds, with the remainder being aromatic compounds. On the other hand, a starting roofing grade asphalt will usually contain about 5 to 15% asphaltenes, about 10 to 35% saturates and about 20 to 35% polar compounds, with the remainder being aromatics.

Since as will be discussed in detail hereinafter, the catalytic oxidation of the present invention results in substantial reduction in saturate content, in one embodiment of the invention where a low saturate content roofing flux is employed, paraffinic hydrocarbon is admixed therewith to increase the saturate content of the flux. For example, with roofing flux having a saturate content approaching 10, say 11, paraffins could be added to the flux to increase the saturate content thereof up to 15 to 35, say about 20. This enables more of the chemical transformations brought about by the present invention to occur. Also, this embodiment illustrates the unique nature of the present invention compared to the use of catalysts such as ferric chloride, since the latter do not significantly affect saturates. As far as is known, any paraffin could be used in the practice of this inventive embodiment, such as waxes, petrolatums, straight or branched chain saturated hydrocarbons, etc. Branched chain saturates, such as petrolatums, are preferred, as illustrated by Example V, hereinafter. The paraffin can be added prior to catalyst or oxidizing gas introduction, or even thereafter during the oxidation process. A convenient method of paraffin introduction is to admix it with the catalyst and then add the admixture to the flux. Of course, this particular embodiment would not be made with paving cements.

The paving and roofing asphalt products that are produced according to the present invention are high grade asphaltic materials which, depending upon product properties, will be used for asphalt paving cements or as roofing asphalts such as shingle saturants and coatings or asphalts for built up roofing. The properties of the respective products do differ but according to the present invention, the amount of saturates that are included in the asphaltic product is from about 25% to about 85% less than the concentration of the saturates included in the precursor flux or bituminous material. In contrast with the use of an acidic catalyst, such as a Lewis acid, the catalyst of the present invention provides a product which has from about 25% to about 75% of the saturates component of the product as compared to that of the acidic catalyst products or those processed without a catalyst. More specifically, the present invention provides a catalytically oxidized paving grade asphalt comprising (by clay gel analysis, n-pentane solvent), about 15 to 25% pentane insoluble asphaltenes, about 3 to 15% saturates, about 30 to 50% polar compounds and about 25 to 35% aromatics, the total content being substantially 100%. The sum of the asphaltenes and polar compounds for a paving grade asphalt will preferably be at least 55%. The roofing grade asphalt comprises about 35 to 45% pentane insoluble asphaltenes, about 5 to 30% saturates, about 30 to 40% polar compounds and about 10 to 30% aromatics, the sum of the asphaltenes and polar compounds being preferably about at least 70%. The % saturates for both paving and roofing grade asphalts will be at least 25% less than the saturate content of the starting flux, preferably at least 75% less, most preferably 80 to 85% less than the saturate content of the starting flux. Most preferably, the saturate content will be about less than 8%.

The catalyst of the present invention offers a number of significant advantages. Uniquely, the carbonate catalyst significantly reduces saturate content, to a lesser extent reduces asphaltene content, significantly increases polar compound content and to a lesser extent increases aromatic content as compared to the same feed oxidized with or without conventional Lewis acid catalyst. Indeed, it appears that the carbonate catalyst essentially selectively oxidizes the saturates with no appreciable change in asphaltene content. This is opposite to the result expected from a normal oxidation with or without Lewis acid catalyst. In fact, this is an ideal oxidation according to the asphalt chemist, since it is well known that a high percentage content of saturates is detrimental to the desired viscosity-penetration relationship, especially for paving grade asphalts, as discussed hereinbefore. Examples hereinbelow illustrate the effect of the catalyst of this invention on the expected clay gel analysis of the asphalt product. A description of a conventional clay gel analysis procedure is set forth below.

CLAY-GEL ADSORPTION CHROMATOGRAPHIC METHOD OF ASPHALT ANALYSIS

Asphalts can be separated into hydrocarbon types and structural groups by this method. Asphaltenes, polar compounds, aromatics, and saturates can be isolated for further study and the yield determined. Asphaltenes are precipitated with n-pentane and filtered. The filtrate is charged to a glass percolation column containing clay in the upper section and silica gel (plus clay) in the lower section. The n-pentane is then charged to the double column until a definite quantity of effluent has been collected. The upper (clay) section is removed from the lower section and washed further with n-pentane which is discarded. A toluene-acetone mixture 50/50 by volume is then charged to the clay section and a specified volume of effluent collected.

The solvents are completely removed from the recovered pentane and the toluene-acetone fractions and the residues are weighed and calculated as saturate and polar compound contents, respectively. Aromatics are calculated by difference.

| Clay-Gel Analysis: | |
|---|---|
| Component Composition: | |
| 1. Asphaltenes (pentane insoluble) | |
| 2. Polar Compounds (Resins) | |
| 3. Aromatics - Resins | Maltenes (portion soluble in pentane) |
| 4. Paraffins (Saturates) | |

Other advantages of the present invention arise from the relatively inexpensive cost of the carbonates, particularly sodium carbonate and sodium sesquicarbonate, the lack of needing to prepare a water solution of the catalyst (ferric chloride is generally used in an aqueous solution form), the ability to avoid the corrosive effect of ferric chloride (believed to be largely caused due to generation of HCl) on manufacturing equipment such as metallic pumps, vats, pipes, and so on, on roofing structures such as metallic vents, flashing, drains, and on cellulosics such as application mops and roofing felts, and so on, reduced environmental pollution since HCl is not generated, the lack of generation of chlorinated aromatics, etc.

Some of the above advantages may be related to the fact that at least a part of the cation content of the carbonate catalyst becomes chemically and/or physically included within the asphalt. For example, with the use of sodium carbonate, at least some portion of the sodium ion and/or sodium metal reacts with the asphalt and cannot be removed by normal washing steps. For example, it is expected that in some embodiments the product of the present invention will contain up to about 30,000 ppm sodium as part of the asphalt component molecules. A typical analysis is less than 10,000 ppm, for example, 1 ppm in the saturate, 13 ppm in the aromatics, 35 ppm in the polar compounds and 3900 ppm in the asphaltenes.

A higher penetration of the asphaltic material for a given softening point or viscosity is an important property which illustrates the high grade of the asphaltic materials produced according to the present invention.

Asphalts produced by the present invention have the following properties: Paving grade asphalts cements have a penetration ranging from about 40 to about 300. Asphalts for built-up roofing have a penetration range from about 12 to about 60. Roofing shingle saturants have a penetration ranging from about 50 to about 90. Roofing coating asphalts have a penetration range from about 15 to about 25.

The asphalt products have softening points ranging from about 110° to about 250° F. The asphalt paving cements have a softening point ranging from about 110° to about 140° F., and the asphalt for built-up roofing has a softening point ranging from about 130° to about 230° F., roofing shingle coating has a softening point ranging from about 210° to about 250° F. and roofing shingle saturant has a softening point from about 110° to about 140° F.

In order to illustrate the advantages and scope of the present invention, the following non-limiting examples are provided.

EXAMPLE I

According to the present invention, a high quality paving grade asphalt cement is produced by air blowing a soft asphalt flux which normally does not yield a specification product when subjected to the air blowing process. The starting flux was made in the refinery by topping the crude oil by distillation under atmospheric conditions to produce a reduced crude residual. Said reduced crude residual was further distilled under reduced pressure to obtain a soft vacuum residual. Said soft vacuum residual without a catalyst was used as a feed to a 500 ml laboratory oxidizer. The temperature of said flux was raised to 480° F. in one hour. At this time, air was injected and dispersed into the oxidizer at a rate equivalent to 50 cu. ft./hr./ton. Said air rate remained constant and the temperature was maintained at 480°–500° F. until the penetration, 77° F./100 g/5 sec., on the blown flux reached a range of 60–70. The aforementioned asphalt flux and process was used as a "blank" or "control" to realistically illustrate the effect of the sodium carbonate catalyst on subsequent oxidations. The identical asphalt flux, air rate, and temperatures were used in successive separate oxidations, except 0.5, 1.0, and 2.0% by weight of sodium carbonate, based on flux, were respectively dissolved in water at 200° F. to enhance dispersion and each solution was respectively added to the three oxidations.

| Test | Test Method | Starting Flux | 0% $Na_2CO_3$ | 0.5% $Na_2CO_3$ | 1.0% $Na_2CO_3$ | 2.0% $NA_2CO_3$ | AASHTO Table II AC-20 SPEC. |
|---|---|---|---|---|---|---|---|
| Vis. at 140° F., Poise | ASTM D2171 | 56 | 1676 | 2160 | 1907 | 1860 | 1600–2400 |
| Pen. 77° F./100 g/5 sec. | ASTM D5 | Soft | 68 | 63 | 66 | 69 | 60 min. |
| Vis. at 275° F., CS | ASTM D2170 | 75 | 324 | 364 | 339 | 346 | 300 min. |
| Sol, Trichloro, % | ASTM D2042 | 99.8 | 99.9 | 99.2 | 99.0 | 97.7 | 99.0+ |
| Soft. Point, °F. | ASTM D36 | — | 121 | 125 | 124 | 122 | — |
| Flash, °F. Coc | ASTM D92 | 610 | — | — | — | — | — |
| Clay Gel Analysis | ASTM D2007 | | | | | | |
| % Asphaltenes | | 10.9 | 23.0 | 20.3 | 20.1 | 20.9 | — |
| % Saturates | | 21.4 | 19.5 | 12.5 | 4.5 | 4.3 | — |
| % Polar Compounds | | 38.6 | 31.8 | 36.5 | 44.4 | 44.7 | — |
| % Aromatics | | 29.1 | 25.7 | 30.7 | 31.0 | 30.1 | — |
| Oxidation Time Hrs. | | — | 8.0 | 5.3 | 3.5 | 4.6 | — |

Table I shows the changes in the physical properties of the starting flux oxidized to AC-20 asphalt cement specifications without a catalyst compared with the identical flux oxidized with varying percentages (0.5, 1.0 and 2.0% of sodium carbonate). An abnormally high exothermic reaction was noted after the addition of sodium carbonate. Obviously 1% sodium carbonate is the optimum percentage to use according to the data in Table I. Larger percentages, although quite effective, decreases the solubility in trichloroethylene below the 99.0% minimum specified by the American Association of State Highway Officials (AASHTO). The chemical changes are dramatic. The saturates content of the 1% sodium carbonate catalyzed sample is about 77% less than the sample oxidized without sodium carbonate. Also there is a substantial increase in the polar compounds (about 40%) and in the aromatics (about 21%). This chemical phenomenon is very unusual and novel. Sodium carbonate selectively oxidizes mostly the saturate components of the asphalt converting them to polar compounds and aromatics. It is well known to those familiar with the art that saturate or paraffinic components, especially straight chain paraffins, are very susceptible to changes in temperature. Thus, the sodium carbonate catalyst of this invention reduces the percentage of the detrimental paraffinic components in said asphalt and increases the viscosities at 140° F. and 275° F. without appreciably affecting the penetration at 77° F./100 g/5 sec. The oxidation time on the 1% sodium carbonate catalyzed sample was 3.5 hours vs. 8.0 hours for the sample oxidized without catalyst. This result shows that the use of a catalyst according to the present invention can reduce the oxidation time for this process by slightly over 50%.

The rise in viscosity at a given penetration of an identical feedstock oxidized with 1.0% sodium carbonate and 0% sodium carbonate are graphically shown on FIG. 1. The asphalt oxidized with sodium carbonate obviously has a higher viscosity at any given penetration.

The relative effectiveness of two catalysts well known to the art: ferric chloride ($FeCl_3$) and phosphorous pentoxide ($P_2O_5$) compared with sodium carbonate and a control sample without catalyst are shown in Table II. All of the oxidations were carried out with the identical starting flux and oxidized under the same conditions of temperature and air rate. The only variation was the type of catalyst. All of the oxidized asphalts met the AASHTO Table II AC-20 specifications. The asphalt produced without a catalyst had a very low viscosity at 140° F. The saturates content is markedly lower on the sample oxidized with sodium carbonate. The asphaltene content is lower on said sample and there is a considerable increase in polar compounds and aromatics. The asphalt oxidized with sodium carbonate is non-corrosive and those oxidized with ferric chloride and phosphorous pentoxide are very corrosive. The oxidation time of the asphalt oxidized with sodium carbonate was 3.5 hours vs. 8.0 hours for the asphalt without catalyst, seven hours for the asphalt oxidized with phosphorous pentoxide catalyst and 3.5 hours for the sample oxidized with ferric chloride.

EXAMPLE II

Asphalt Roofing Coating

In a second part of our invention, we produced a high quality roofing asphalt coating in plant scale experiments in order to demonstrate the effectiveness of sodium carbonate catalyst vs. ferric chloride, and as compared with oxidation without the use of a catalyst. Identical feedstock was used in each experiment.

TABLE II

OXIDATION OF VACUUM RESIDUAL STARTING FLUX WITHOUT CATALYST COMPARED WITH CATALYTIC OXIDATION WITH SODIUM CARBONATE, FERRIC CHLORIDE, AND PHOSPHORUS PENTOXIDE

| Test | Test Method | Starting Flux | 0% Catalyst | 1% $Na_2CO_3$ | 0.1% $FeCl_3$ | 1% $P_2O_5$ | AASHTO Table II AC-20 SPEC. |
|---|---|---|---|---|---|---|---|
| Vis. at 140° F., Poise | ASTM D2171 | 56 | 1676 | 1907 | 2000 | 2000 | 1600–2400 |
| Pen. 77° F./100 g/5 sec. | ASTM D5 | Soft | 68 | 66 | 60 | 66 | 60 min. |
| Vis. at 275° F., Cs | ASTM D2170 | 75 | 324 | 339 | 363 | 390 | 300 min. |
| Sol, Trichloro, % | ASTM D2042 | 99.8 | 99.9 | 99.0 | 99.7 | 99.2 | 99.0+ |
| Soft. Point, °F. | ASTM D36 | — | 121 | 124 | 125 | 125 | — |
| Flash, Coc, °F. | ASTM D92 | 610 | — | — | — | — | — |
| Clay Gel Analysis | ASTM D2007 | | | | | | |
| % Asphaltenes | | 10.9 | 23.0 | 20.1 | 23.7 | 26.3 | — |
| % Saturates | | 21.4 | 19.5 | 4.5 | 20.1 | 18.9 | — |
| % Polar Compounds | | 38.6 | 31.8 | 44.4 | 28.3 | 28.4 | — |
| % Aromatics | | 29.1 | 25.7 | 31.0 | 27.9 | 26.4 | — |
| Oxidation Time Hrs. | | — | 8.0 | 3.5 | 3.5 | 7.0 | — |

Figure 2:
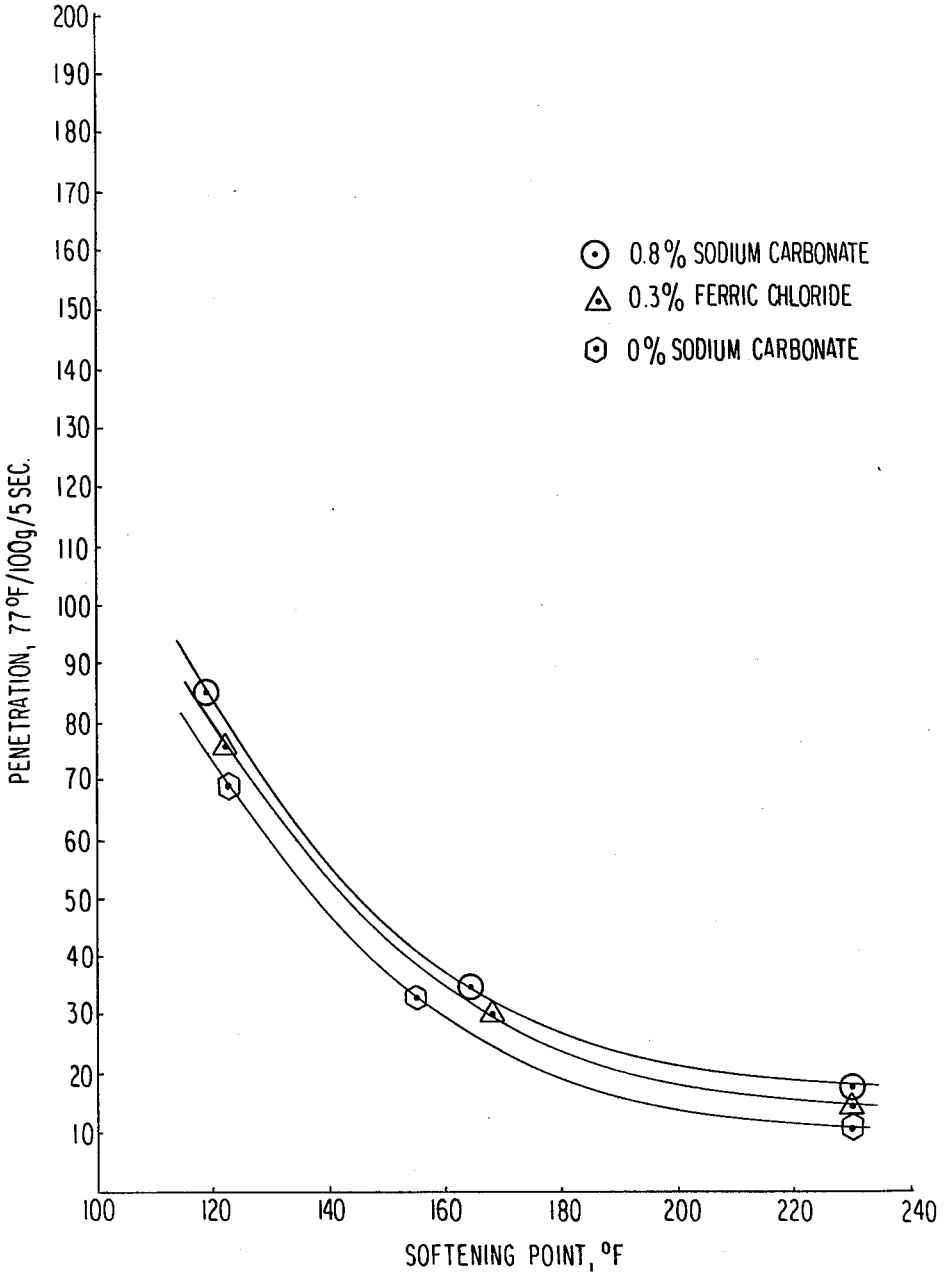
FIGS. 2 and 3 of the Drawing are graphs plotting the "blowing curves" (penetration versus softening point) of the experimental oxidation runs of Examples II and III, hereinbelow.

A 7,000 gallon asphalt oxidizer was charged in each experiment with said feedstock. In the experiment containing no catalyst, the temperature on the batch oxidizer was raised to 440° F. At this time, air was introduced and dispersed in the oxidizer at a rate of 35 SCFH per ton of feedstock until laboratory tests showed that the asphalt was within the softening point specification range. This experiment was repeated successively by experiments respectively using ferric chloride and sodium carbonate. All other conditions were the same. The sodium carbonate (0.8% based on the weight of the starting flux in the oxidizer) was dissolved in water and injected into the top of the oxidizer. The ferric chloride (0.3% based on the weight of the starting flux in the oxidizer) was injected into the oxidizing vessel in the exact same manner. The "blowing curves" of the three asphalts are shown in FIG. 2. The sample oxidized with ferric chloride excelled the one oxidized without catalyst. The sample oxidized with sodium carbonate excelled both the one oxidized without a catalyst and the one oxidized with 0.3% ferric chloride. Again, the asphalt oxidized with sodium carbonate has a higher penetration for any given softening point or is less susceptible to changes in temperature.

EXAMPLE III

Sodium Carbonate Catalyst

Figure 3:
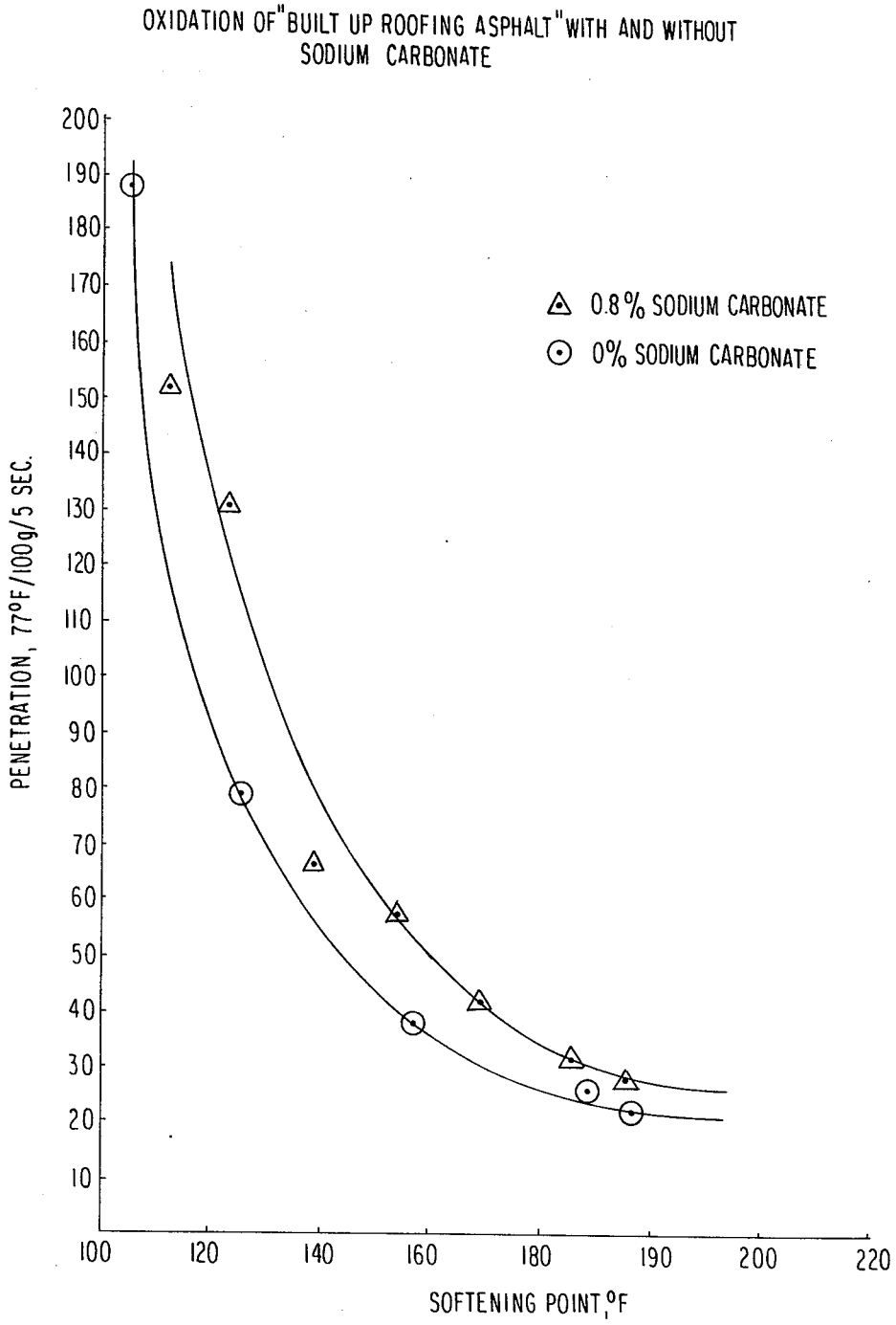

We performed another larger plant experiment in a different plant from that cited in Example II to further illustrate the effectiveness of sodium carbonate catalyst vs. oxidation without a catalyst on a feedstock derived from a different crude source. A 27,720 gallon batch asphalt oxidizing vessel was charged with said feedstock. No catalyst was used in the first experiment. The temperature in the oxidizer was raised to 350° F. and at this temperature air was introduced and dispersed into the oxidizer at a rate of 15 SCFH per ton. When the temperature reached 490° F., a water spray was used to spray the top of the molten asphalt within the oxidizer to maintain a temperature of 490°–500° F. This water spray was used to control the temperature at the 490°–500° F. range for safety reasons established by the refinery where the test was conducted. The temperature (490°–500° F.) was maintained until the oxidation was concluded as dictated by laboratory results on the oxidized asphalt which showed that the asphalt was within specification range. In a second part of the experiment, the said identical starting flux was oxidized in the exact manner except 0.8% sodium carbonate, based on weight of flux, was dissolved in water at 200° F. and introduced into the top of the oxidizer at the surface of the molten asphalt at the same time air was introduced into the bottom of the oxidizer. FIG. 3 shows the results of the experiment and illustrates that at a given softening point the corresponding penetration is higher on the asphalt catalytically oxidized with sodium carbonate or the said catalytically oxidized asphalt is less susceptible to changes in temperature than the asphalt oxidized without a catalyst.

EXAMPLE IV

A number of plant scale runs were carried out with the following results. These runs illustrate the use of dry catalyst being directly added to the oxidizer containing asphalt flux.

A. Commercially available sodium sesquicarbonate crystals were pressure injected into an oxidizer containing 400 barrels of an asphalt flux derived from Illinois Basin crude oil (0.5% by weight of catalyst based on the flux). The carbonate crystals were injected after the oxidizer had reached a temperature of about 350° F. The oxidation was carried out for approximately 20 hours during which time the temperature gradually increased to 500° F. The asphalt product had a penetration of 19 and a softening point of 224° F., in comparison with a control (no catalyst) which had a penetration of 17 and a softening point of 216° F. after the same length of time.

B. In another run, but using an asphalt flux obtained from Murban crude oil and 0.6% by weight of the crystalline sodium sesquicarbonate as catalyst, and a maximum temperature of 490° F. after 24 hours an asphalt having a penetration of 19 and a softening point of 225° F. was obtained. This time, the control run yielded an asphalt having a penetration of 15 and a softening point of 225° F.

C. In this run, 400 barrels of a mixed asphalt flux, that is derived from mixed crude oil sources, was oxidized in the presence of 0.25% by weight sodium carbonate provided to the oxidizer in a dry powdered form. The oxidation was carried out for 26 hours at a maximum temperature of 500° F. The product had a penetration of 18 and a softening point of 223° F. The values obtained with the control oxidized under the same conditions in the absence of catalyst were a penetration of 14 and softening point of 224° F.

D. Another mixed asphalt flux was oxidized for 27 hours at a maximum temperature of 500° F. in the presence of 0.5% by weight dry powdered sodium carbonate to yield an asphalt having a penetration of 20 and a softening point of 222° F. The control yielded a product having a penetration of 14 and a 224° F. softening point.

In each of the above runs A through D, the total amount of catalyst was added when the oxidizer reached the oxidation temperature of about 350° F.

EXAMPLE V

This example illustrates the embodiment of the present invention where a paraffinic hydrocarbon is admixed with a low saturate content roofing grade flux and then the catalytic oxidation of the present invention is carried out.

A number of laboratory runs were carried out. In each run, 500 grams of the same roofing grade flux having a saturate content of 11% was oxidized at 480° F. with air as oxidizing gas being provided at a rate of 1.0 SCFH (one standard cubic foot per hour). In each of the runs where sodium carbonate was used as a catalyst during the oxidation, it was added to the flux, in an amount to provide 1% sodium carbonate based on weight of the flux, in the form of a water solution thereof prior to commencement of addition of the oxidizing gas.

Run A

In the first run, carried out without catalyst addition, the asphalt product had a penetration of 10 and a softening point of 230° F. after an oxidation time of 21 hours.

Run B

Run B was identical to Run A except for the addition of the sodium carbonate catalyst. The asphalt product had a penetration of 10 and a softening point of 241° F. after 21 hours oxidation time.

Run C

Run C was identical to Run A except that the starting flux consisted of 90% of the flux of Run A admixed with 10% wax. After 24 hours oxidation time, the asphalt product had a penetration of 15 and a softening point of 229° F.

Run D

Run D was identical to Run C (10% wax) except that the sodium carbonate catalyst was present during the oxidation. The asphalt product had a penetration of 18 and a softening point of 239° F. after 21 hours oxidation time.

Run E

Run E was identical to Run C except that the wax content was raised to 20% (80% Run A flux/20% wax). The asphalt product had a penetration of 19 and a softening point of 227° F. after 14.5 hours oxidation time.

Run F

Run F was identical to Run C except that a petrolatum was used in place of the wax as the added saturate. After 16⅓ hours oxidation time, the asphalt product had a penetration of 11 and a softening point of 232° F.

Run G

Run G was identical to Run F except that the sodium carbonate catalyst was present. The asphalt product had a penetration of 17 and a softening point of 230° F. after 8.5 hours oxidation time.

Variations of the invention will be apparent to the skilled artisan.

We claim:

1. A process for producing a high grade asphaltic material, which process comprises oxidizing a bituminous material, having a viscosity of about 30 to 400 saybolt fural seconds at 210° F., at a temperature of about 350° F. to 550° F. by passing an oxidizing gas through the bituminous material in the presence of a catalytic amount of an inorganic carbonate salt or an organic carbonate salt as an oxidation catalyst, whereby said high grade asphaltic material is produced.

2. A process for producing a high grade paving asphaltic material, which process comprises oxidizing a bituminous material, containing by weight about 10 to 20% asphaltenes, about 15 to 25% saturates and about 20 to 35% polar compounds, with the remainder being substantially aromatics, and having a viscosity of about 30 to 400 saybolt fural seconds at 210° F., at a temperature of about 350° F. to 550° F. by passing an oxidizing gas through the bituminous material in the presence of a catalytic amount of an inorganic carbonate salt or an organic carbonate salt as an oxidation catalyst, whereby said high grade paving asphaltic material is produced.

3. A process for producing a high grade roofing, shingle saturate or shingle coating asphaltic material, which process comprises oxidizing a bituminous material, containing by weight about 5 to 15% asphaltenes, about 10 to 35% saturates and about 20 to 35% polar compounds, with the remainder being aromatics, and having a viscosity of about 30 to 400 saybolt fural seconds at 210° F., at a temperature of about 350° F. to 550° F. by passing an oxidizing gas through the bituminous material in the presence of a catalytic amount of an inorganic carbonate salt or an organic carbonate salt as an oxidation catalyst, whereby said high grade roofing, shingle saturate or shingle coating asphaltic material is produced.

4. The process of claims 1, 2 or 3, wherein said bituminous material is selected from the group consisting of slurry oil, coal tar, coal tar pitch, petroleum pitch, cycle oils, asphalt, cylinder stock, and liquid derived from shale, coal liquefaction materials and aromatic furfural extracts from solvent refining of lube oil and mixtures thereof.

5. The process of claim 2, wherein said oxidation is carried out for about ½ to 6 hours.

6. The process of claim 3, wherein said oxidation is carried out for about 2 to 35 hours.

7. A process according to claim 1, wherein said asphaltic material has a penetration of from about 12 to 300 and a softening point of about 110° F. to 250° F.

8. A process according to claim 2, wherein said asphaltic material has a penetration ranging from about 40 to 300 and a softening point of about 110° to 140° F.

9. A process according to claim 3, wherein said asphaltic material is (1) asphalt for built-up roofing having penetration of from about 12 to 60 and a softening point of from about 130° to 230° F., (2) roofing shingle saturant having a penetration of from about 50 to 90 and a softening point of from about 110° to 140° F. or (3) roofing coating asphalt having a penetration of about 15 to 25 and a softening point of about 210° to 250° F.

10. A process according to claims 1, 2 or 3, wherein said catalyst is added in an amount ranging from about 0.1 to 2.0 weight percent of said bituminous material.

11. A process according to claims 1, 2 or 3, wherein said catalyst is added in an amount ranging from about 0.01 to 5.0 weight percent of said bituminous material.

12. A process according to claims 1, 2 or 3, wherein said catalyst is added in an amount ranging from about 0.1 to 1.0 weight percent of said bituminous material.

13. The process of claims 1, 2 or 3, wherein the reaction is conducted at a pressure of one atmosphere or above and the oxidizing gas is passed through the flux material at a rate ranging from about 15 to 35 cubic feet per hour, per ton, of flux material.

14. The process of claims 1, 2 or 3, wherein the process is carried out at a temperature of about between 480° F. and 550° F.

15. The process of claims 1, 2 or 3, wherein the oxidation process is carried out at a temperature of above the melting point of said bituminous material.

16. The process of claims 1, 2 or 3, wherein the catalyst is a mixture of sodium carbonate and bicarbonate.

17. The process of claims 1, 2 or 3, wherein said catalyst is an inorganic carbonate salt.

18. The process of claim 17, wherein said catalyst is sodium carbonate or sodium sesquicarbonate.

19. The process of claim 18, wherein said catalyst is sodium sesquicarbonate.

20. The process of claim 18, wherein said catalyst is sodium carbonate.

21. The process of claim 17, wherein said catalyst is sodium bicarbonate.

22. The process of claims 1, 2 or 3, wherein the catalyst is a carbonate or bicarbonate salt of calcium, magnesium, cerium, barium, strontium, lithium, ammonium, potassium, bismuth, lead, tetraalkylphosphonium, tetraarylphosphonium, tetraalkylammonium, trialkylammonium, dialkylammonium, transition metals or rare earth metals.

23. The process according to claims 1, 2 or 3, wherein the saturate content by weight of said asphaltic material is from about 25% to 85% of the saturates contained in said bituminous feedstock flux material.

24. The process according to claims 1, 2 or 3, wherein said asphaltic material has by weight from about 25% to about 75% of the saturates contained in non-catalyzed oxidized identical bituminous feedstock flux material.

25. The process according to claims 1, 2 or 3, wherein said asphaltic material has from about 25% to about 75% of the saturates contained in Lewis acid catalyzed oxidized identical bituminous feedstock flux material.

26. The process of claims 1, 2 or 3, wherein the process is carried out in a continuous fashion.

27. The process of claims 1, 2 or 3, wherein the process is carried out in a batch fashion.

28. The process of claims 1, 2 or 3, wherein said catalyst is admixed with water or with liquid bituminous material and then the admixture is introduced into the bituminous material to be oxidized.

29. The process of claims 1, 2 or 3, wherein said catalyst is introduced into said bituminous material in particulate form.

30. The process of claims 1 or 3, wherein prior to oxidation, a paraffin is introduced into the bituminous material to increase the saturate content thereof.

31. The process of claims 2, 5 or 8, wherein said asphaltic material consists essentially by weight of about 15 to 25% asphaltenes, about 3 to 15% saturates, about 30 to 50% polar compounds and 25 to 35% aromatics.

32. The process of claims 3, 6 or 9, wherein said asphaltic material consists essentially by weight of about 35 to 45% asphaltenes, about 5 to 30% saturates, about 30 to 40% polar compounds and about 10 to 30% aromatics.

33. A non-corrosive high grade paving asphaltic material consisting essentially of by clay gel analysis using n-pentane solvent about 15% to 25% pentane insoluble asphaltenes, about 3% to 15% pentane soluble saturates, about 30% to 50% pentane soluble polar compounds and about 25% to 35% pentane soluble aromatics, by weight, and wherein the sum of the asphaltenes and polar compounds is at least about 55% by weight and wherein the saturate content thereof is 25% to 80% by weight less than the saturate content of the starting flux.

34. A non-corrosive high grade roofing, shingle saturant or shingle coating asphaltic material consisting essentially of by clay gel analysis using n-pentane solvent about 35 to 45% pentane insoluble asphaltenes, about 5 to 30% pentane soluble saturates, about 30 to 40% pentane soluble polar compounds and about 10 to 30% pentane soluble aromatics, by weight, and wherein the sum of the asphaltenes and polar compounds is at least about 70% by weight and wherein the saturate content thereof is 25 to 85% by weight less than the saturate content of the starting flux.

35. The asphaltic material of claim 33 or 34, wherein the saturate content by weight is at least 75% less than the saturate content of the starting flux.

36. The asphaltic material of claim 33 or 34, wherein the saturate content by weight is at least 80% less than the saturate content of the starting flux.

37. The asphaltic material of claim 33 having a penetration ranging from about 40 to 300 and a softening point of about 110° to 140° F.

38. The asphalt material of claim 34 as an asphalt for built-up roofing having a penetration of about 12 to 60 and a softening point of about 130° F. to 230° F.

39. The asphalt material of claim 34 as a roofing shingle saturant having a penetration of about 50 to 90 and a softening point of about 110° F. to 140° F.

40. The asphalt material of claim 34 as a roofing coating asphalt having a penetration of about 15 to 25 and a softening point of about 210° F. to 250° F.

41. The asphaltic material of claim 23 containing up to about 30,000 ppm sodium introduced by said asphaltic material having been prepared using a catalyst comprising sodium carbonate.

42. The asphaltic material of claim 34 containing up to about 30,000 ppm sodium introduced by said asphaltic material having been prepared using a catalyst comprising sodium carbonate.

43. A non-corrosive high grade paving asphaltic material made by the process of claim 2, said asphaltic material consisting essentially of by clay gel analysis using n-pentane solvent about 15% to 25% pentane insoluble asphaltenes, about 3% to 15% pentane soluble saturates, about 30% to 50% pentane soluble polar compounds and about 25% to 35% pentane soluble aromatics by weight and wherein the sum of the asphaltenes and polar compounds is at least about 55% by weight and wherein the saturate content is 25% to 85% by weight less than the saturate content of the starting flux.

44. A non-corrosive high grade roofing, shingle saturant or shingle coating asphaltic material made by the process of claim 3, and consisting essentially of by clay gel analysis using n-pentane solvent of about 35 to 45% pentane insoluble asphaltenes, about 5 to 30% pentane soluble saturates, about 30 to 40% pentane soluble polar compounds and about 10 to 30% pentane soluble aromatics by weight and wherein the sum of the asphaltenes and polar compounds is at least about 70% by weight and wherein the saturate content is 25 to 85% by weight less than the saturate content of the starting flux.

45. The asphaltic material of claim 43 or 44, wherein the saturate content by weight is at least 75% less than the saturate content of the starting flux.

46. The asphaltic material of claim 43 or 44 wherein the saturate content by weight is at least 80% less than the saturate content of the starting flux.

47. The asphaltic material of claim 43, as a paving grade asphalt cement having a penetration of about 40 to 300 and a softening point of about 110° F. to 140° F.

48. The asphaltic material of claim 44, as an asphalt for built-up roofing having a penetration of about 12 to 60 and a softening point of about 130° F. to 230° F.

49. The asphaltic material of claim 44, as a roofing shingle saturate having a penetration of about 50 to 90 and a softening point of about 110° F. to 140° F.

50. The asphaltic material of claim 44, as a roofing coating asphalt having a penetration of about 15 to 25 and a softening point of about 210° F. to 250° F.

51. The asphaltic material of any of claims 43, 44, 45 or 46, wherein the catalyst comprises sodium carbonate.

52. The asphaltic material of claim 51 containing up to about 30,000 ppm sodium.

53. The process of claim 30 wherein said paraffin is a wax or a petrolatum.

54. The process of claim 53 wherein said paraffin is a branched chain paraffin.

55. The process of claim 54 wherein said paraffin is petrolatum.

* * * * *